US009362042B2

(12) United States Patent
Yoneda et al.

(10) Patent No.: US 9,362,042 B2
(45) Date of Patent: Jun. 7, 2016

(54) ELECTRONIC COMPONENT

(71) Applicant: MURATA MANUFACTURING CO., LTD., Kyoto (JP)

(72) Inventors: Masayuki Yoneda, Nagaokakyo (JP); Kenji Yoshida, Nagaokakyo (JP); Yasunari Nakashima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/203,497

(22) Filed: Mar. 10, 2014

(65) Prior Publication Data

US 2014/0306792 A1 Oct. 16, 2014

(30) Foreign Application Priority Data

Apr. 11, 2013 (JP) ..... 2013-083048

(51) Int. Cl.

| | |
|---|---|
| ***H01F 5/00*** | (2006.01) |
| ***H01F 27/26*** | (2006.01) |
| ***H01F 27/28*** | (2006.01) |
| ***H01F 17/00*** | (2006.01) |

(52) U.S. Cl.

CPC ..... *H01F 27/2804* (2013.01); *H01F 17/0013* (2013.01); *H01F 2017/002* (2013.01)

(58) Field of Classification Search

CPC ..... H01F 5/00; H01F 27/28

USPC ..... 336/200, 232

See application file for complete search history.

(56) References Cited

U.S. PATENT DOCUMENTS

| | | | | |
|---|---|---|---|---|
| 5,515,022 | A * | 5/1996 | Tashiro | H01F 17/0013 174/262 |
| 6,580,350 | B1 | 6/2003 | Kobayashi | |
| 7,135,951 | B1 | 11/2006 | Sidhu et al. | |
| 2008/0048813 | A1 * | 2/2008 | Mosley et al. | 336/65 |
| 2008/0246579 | A1 * | 10/2008 | Mizuno et al. | 336/205 |
| 2009/0115563 | A1 * | 5/2009 | Arata | H01F 17/0013 336/200 |
| 2010/0194513 | A1 | 8/2010 | Ozawa et al. | |
| 2010/0328009 | A1 * | 12/2010 | Tawa | 336/200 |
| 2013/0176096 | A1 * | 7/2013 | Takahashi | 336/200 |

FOREIGN PATENT DOCUMENTS

| | | | |
|---|---|---|---|
| JP | 2000-286125 | A | 10/2000 |
| JP | 2008-004605 | A | 1/2008 |
| JP | 2009-117664 | A | 5/2009 |
| JP | 2010-192889 | A | 9/2010 |
| WO | WO 2007072612 | A1 * | 6/2007 |

OTHER PUBLICATIONS

An Office Action; "Notification of Reasons for Rejection," issued by the Japanese Patent Office on Feb. 24, 2015, which corresponds to Japanese Patent Application No. 2013-083048 and is related to U.S. Appl. No. 14/203,497; with English language translation.

* cited by examiner

*Primary Examiner* — Tsz Chan
(74) *Attorney, Agent, or Firm* — Studebaker & Brackett PC

(57) ABSTRACT

An electronic component having: a laminate formed by laminating a plurality of insulator layers; and a coil consisting of linear coil conductor layers that are laminated along with the insulator layers, the coil having a spiral form or a helical form that windingly extends in a direction of lamination. In a cross section perpendicular to a direction in which the coil conductor layers extend, the coil conductor layers have recesses provided in their surfaces directed toward an inner circumference side of the coil, the recesses being set back toward an outer circumference side of the coil.

9 Claims, 15 Drawing Sheets

ELECTRONIC COMPONENT

CROSS REFERENCE TO RELATED APPLICATIONS

This application claims benefit of priority to Japanese Patent Application No. 2013-083048 filed on Apr. 11, 2013, the entire content of which is incorporated herein by reference.

TECHNICAL FIELD

The technical field relates to electronic components, more particularly to an electronic component with an internal coil.

BACKGROUND

As an disclosure relevant to a conventional electronic component, a multilayer electronic component disclosed in, for example, Japanese Patent Laid-Open Publication No. 2000-286125, is known. This multilayer electronic component includes a laminate and a coil. The laminate is formed by laminating a plurality of ferrite sheets. The coil includes a plurality of coil conductor patterns that are connected via through-holes so as to wind helically in the direction of lamination.

Incidentally, to achieve, for example, a low direct-current resistance in the coil, the multilayer electronic component disclosed in Japanese Patent Laid-Open Publication No. 2000-286125 is required to have wider or thicker coil conductor patterns, but in such a case, it is difficult to achieve a large inductance value. More specifically, in the case of a helical coil, the density of magnetic flux in the coil is high. In this case, magnetic flux that does not flow through the coil passes through the surfaces of the coil conductor patterns. Because a high-frequency signal flows through the coil, the direction of magnetic flux generated by the coil varies cyclically. In the case where the direction of magnetic flux that passes through the coil conductor patterns varies cyclically, eddy currents are generated in the coil conductor patterns, so that Joule's heat is produced. As a result, an eddy-current loss occurs, leading to a reduced inductance value of the coil.

SUMMARY

An electronic component according to an embodiment of the present disclosure includes a laminate formed by laminating a plurality of insulator layers, and a coil including linear coil conductor layers laminated along with the insulator layers, the coil having a helical form, which windingly extends in a direction of lamination, or a spiral form. In a cross section perpendicular to a direction in which the coil conductor layers extend, the coil conductor layers have recesses provided in their surfaces directed toward an inner circumference side of the coil, the recesses being set back toward an outer circumference side of the coil.

DETAILED DESCRIPTION

Hereinafter, an electronic component according to an embodiment of the present disclosure will be described.

Structure of Electronic Component

Figure 1:
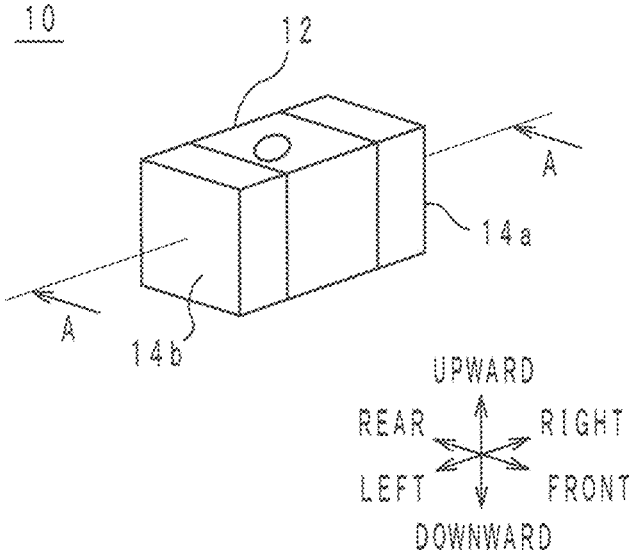
FIG. 1 is an external oblique view of an electronic component according to an embodiment.
Figure 2:
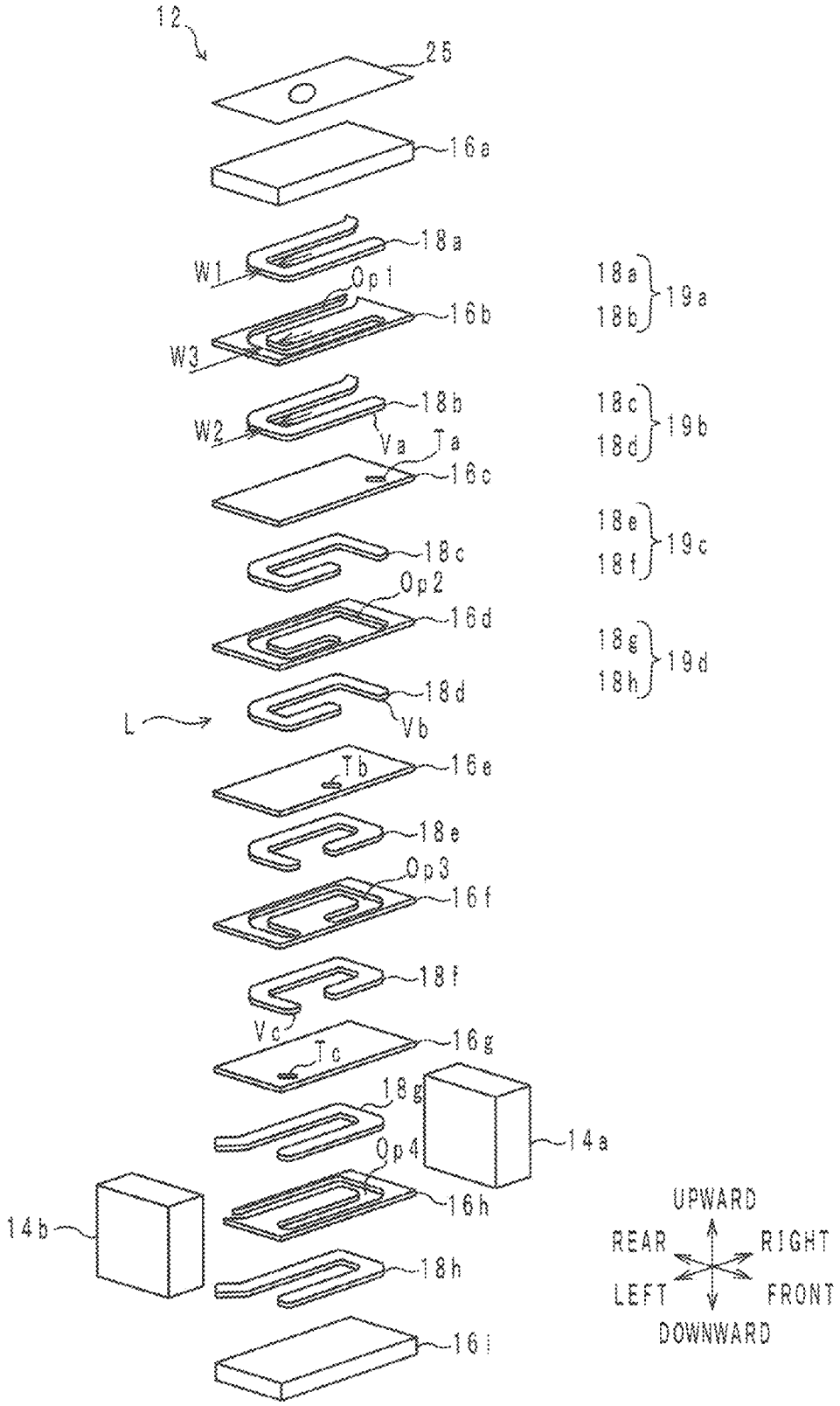
FIG. 2 is an exploded oblique view of the electronic component in FIG. 1.
Figure 3:
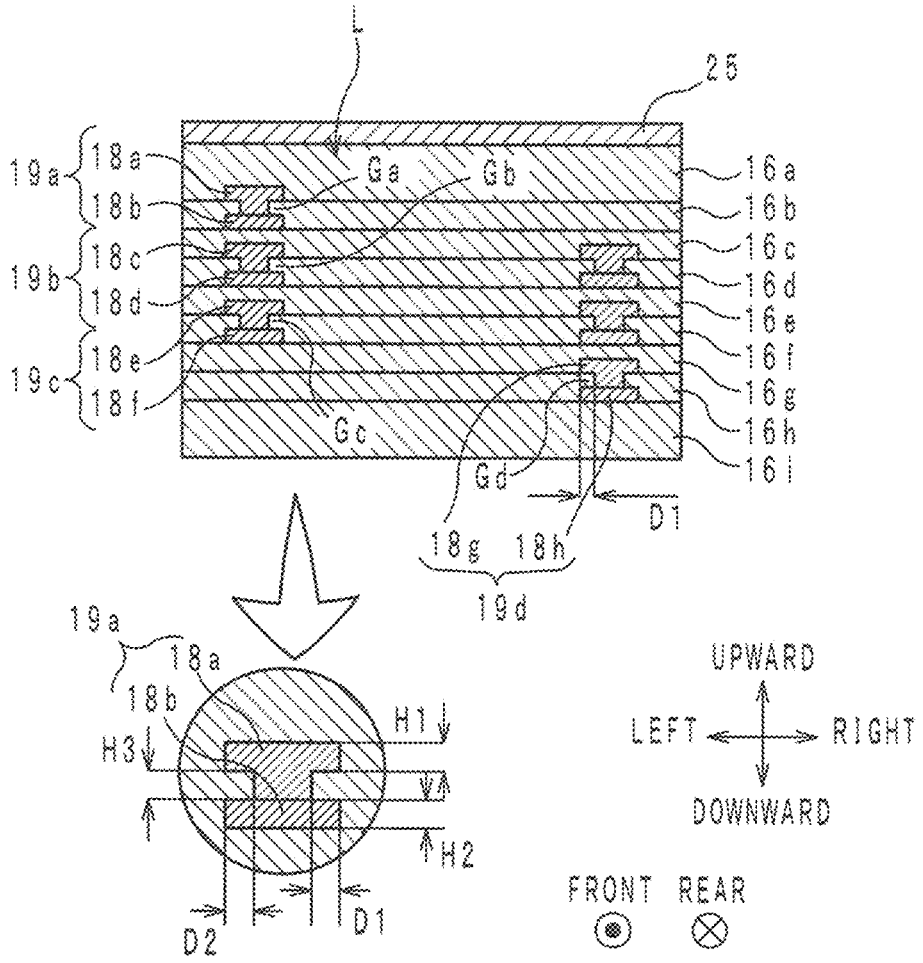
FIG. 3 is a cross-sectional structure view of a laminate of the electronic component taken along line A-A of FIG. 1 and an enlarged area of the laminate.

The structure of the electronic component according to the embodiment will be described below with reference to the drawings. FIG. 1 is an external oblique view of the electronic component 10 according to the embodiment. FIG. 2 is an exploded oblique view of the electronic component 10 in FIG. 1. FIG. 3 is a cross-sectional structural view of a laminate 12 of the electronic component 10 taken along line A-A of FIG. 1. In FIG. 3, external electrodes 14*a* and 14*b* are not shown. In the following, the direction of lamination of the laminate 12 will be defined as a top-bottom direction. In addition, when the laminate 12 is viewed in a top view, the direction in which the short side of the laminate 12 extends will be defined as a front-back direction, and the direction in which the long side of the laminate 12 extends will be defined as a right-left direction.

As shown in FIGS. 1 through 3, the electronic component 10 includes the laminate 12, the external electrodes 14*a* and 14*b*, and a coil L. The laminate 12 is in the form of a rectangular solid formed by laminating insulator layers 25 and 16*a* to 16*i*. The insulator layers 25 and 16*a* to 16*i* are laminated in this order, from top to bottom, and have rectangular edges.

The insulator layer 25 has a blank circle marked thereon. The blank circle is used as a direction marker. Moreover, the insulator layers 16*b*, 16*d*, 16*f*, and 16*h* have respective openings Op1 to Op4 provided therein. In addition, the insulator layers 16*c*, 16*e*, and 16*g* have respective through-holes Ta to Tc provided therein. In this manner, the insulator layers 16*b*, 16*d*, 16*f*, and 16*h* with the openings Op1 to Op4 and the insulator layers 16*c*, 16*e*, and 16*g* without openings are laminated so as to alternate with each other. The openings Op1 to Op4 and the through-holes Ta to Tc will be described later. The insulator layers 16*a* to 16*i* are made from glass containing a magnetic material. Upper and lower surfaces of the insulator layers 16*a* to 16*i* will be referred to below as top and bottom surfaces, respectively.

The coil L spirals clockwise when viewed in a top view, so as to take a helical form continuing from bottom to top. The coil L includes coil conductor layers 19*a* to 19*d* and via-hole conductors Va to Vc. The coil conductor layers 19*a* to 19*d* are linear conductors laminated along with the insulator layers 16*a* to 16*i*, and when viewed in a top view, they wind clockwise around the center of the laminate 12 (the intersection of diagonals). The coil conductor layers 19*a* to 19*d* are made of, for example, a conductive material mainly composed of Ag. In the following, the ends of the coil conductor layers 19*a* to 19*d* that are located upstream in the clockwise direction will be simply referred to as the upstream ends, and the ends of the coil conductor layers 19*a* to 19*d* that are located downstream in the clockwise direction will be simply referred to as the downstream ends.

Furthermore, the coil conductor layer 19*a* includes coil conductor layers 18*a* and 18*b*, as shown in FIG. 2. The coil conductor layers 18*a* and 18*b* have approximately the same shape when viewed in a top view, and are stacked vertically. More specifically, the coil conductor layer 18*b* is positioned on the top surface of the insulator layer 16*c*. The opening Op1 is provided in the insulator layer 16*b*, as mentioned earlier. The opening Op1 has a linear shape which, when viewed in a top view, overlaps with the coil conductor layer 18*b* and is approximately the same as the shape of the coil conductor layer 18*b*. However, the width W3 of the opening Op1 is less than both the width W1 of the coil conductor layer 18*a* and the W2 of the coil conductor layer 18*b*.

The coil conductor layer 18*a* is provided on the top surface of the insulator layer 16*b* so as to be partially positioned in the opening Op1, as shown in FIGS. 2 and 3. Note that the coil conductor layer 18*a*, when viewed in a top view, reaches beyond the edge of the opening Op1 on the top surface of the insulator layer 16*b*. Accordingly, in a cross section perpendicular to the direction in which the coil conductor layer 18*a* extends, the coil conductor layer 18*a* is in the shape of a T. Moreover, the lower surface of the coil conductor layer 18*a* contacts the upper surface of the coil conductor layer 18*b*. Accordingly, in a cross section perpendicular to the direction in which the coil conductor layer 19*a* extends, the coil conductor layer 19*a* is in the shape of an H rotated 90 degrees. Therefore, in the cross section perpendicular to the direction in which the coil conductor layer 19*a* extends, the surface of the coil conductor layer 19*a* that is directed toward the inner circumference side of the coil L has a recess Ga set back toward the outer circumference side of the coil L. The depth D1 of the recess Ga (see FIG. 3) is preferably 6 μm or more, which is 40% or less of the width W1 or W2 of the coil conductor layers 18*a* to 18*h*.

The coil conductor layer 19*b* includes the coil conductor layers 18*c* and 18*d*, as shown in FIG. 2. The coil conductor layer 19*c* includes the coil conductor layers 18*e* and 18*f*, as shown in FIG. 2. The coil conductor layer 19*d* includes the coil conductor layers 18*g* and 18*h*, as shown in FIG. 2. The configurations of the coil conductor layers 19*b* to 19*d* are similar to that of the coil conductor layer 19*a*, and therefore, any descriptions thereof will be omitted. Moreover, the configurations of the openings Op2 to Op4 are similar to that of the opening Op1, and therefore, any descriptions thereof will be omitted.

The through-holes Ta to Tc are holes that vertically pierce through the insulator layers 16*c*, 16*e*, and 16*g*, respectively. The through-hole Ta, when viewed in a top view, overlaps with both the upstream end of the coil conductor layer 18*b* and the downstream end of the coil conductor layer 18*c*. The through-hole Tb, when viewed in a top view, overlaps with both the upstream end of the coil conductor layer 18*d* and the downstream end of the coil conductor layer 18*e*. The through-hole Tc, when viewed in a top view, overlaps with both the upstream end of the coil conductor layer 18*f* and the downstream end of the coil conductor layer 18*g*.

The via-hole conductor Va projects downward from the upstream end of the coil conductor layer 18*b* so as to be positioned in the through-hole Ta. Accordingly, the via-hole conductor Va connects the upstream end of the coil conductor layer 18*b* to the downstream end of the coil conductor layer 18*c*. The via-hole conductor Vb projects downward from the upstream end of the coil conductor layer 18*d* so as to be positioned in the through-hole Tb. Accordingly, the via-hole conductor Vb connects the upstream end of the coil conductor layer 18*d* to the downstream end of the coil conductor layer 18*e*. The via-hole conductor Vc projects downward from the upstream end of the coil conductor layer 18*f* so as to be positioned in the through-hole Tc. Accordingly, the via-hole conductor Vc connects the upstream end of the coil conductor layer 18*f* to the downstream end of the coil conductor layer 18*g*. Thus, the coil conductor layers 19*a* to 19*d* are connected by the via-hole conductors Va to Vc, thereby forming the helical coil L.

The external electrode 14*a* covers the right end surface of the laminate 12, and is bent toward the top, bottom, front, and back surfaces of the laminate 12. The downstream end of the coil conductor layer 19*a* is led out to the right end surface of the laminate 12. Accordingly, the downstream end of the coil conductor layer 19*a* is connected to the external electrode 14*a*.

The external electrode 14*b* covers the left end surface of the laminate 12, and is bent toward the top, bottom, front, and back surfaces of the laminate 12. The upstream end of the coil conductor layer 19*d* is led out to the left end surface of the laminate 12. Accordingly, the upstream end of the coil conductor layer 19*d* is connected to the external electrode 14*b*.

Method for Producing Electronic Component

Next, the method for producing the electronic component 10 will be described with reference to the drawings. FIGS. 4 through 19 are cross-sectional views corresponding to the steps in the production of the electronic component 10. While the following description focuses on the process of producing one electronic component 10, in actuality, a mother laminate is produced and cut, thereby obtaining a plurality of electronic components 10 simultaneously.

Figure 4:
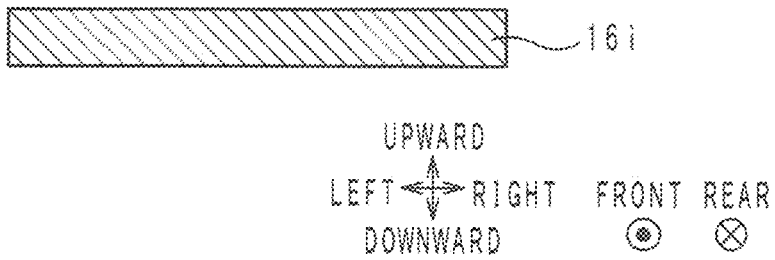
FIG. 4 is a cross-sectional view corresponding to a step in the production of the electronic component.
Figure 5:
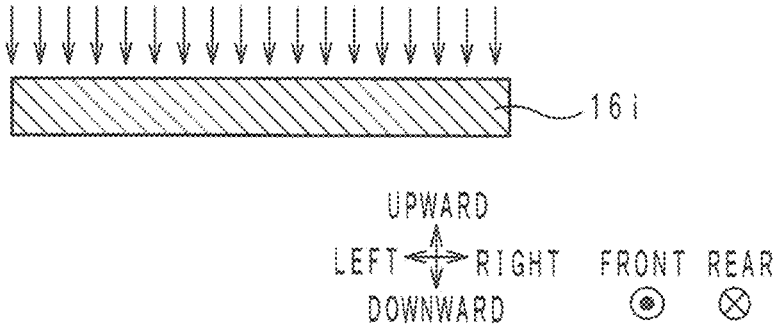
FIG. 5 is a cross-sectional view corresponding to a step in the production of the electronic component.

Initially, a photosensitive insulator paste is applied by printing, as shown in FIG. 4. Thereafter, the entire surface of the photosensitive insulator paste is exposed to light, as shown in FIG. 5. As a result, the photosensitive insulator paste is cured, so that an insulator layer 16*i* is formed.

Figure 6:
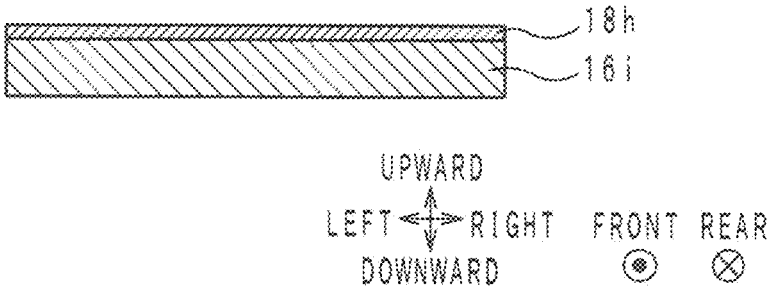
FIG. 6 is a cross-sectional view corresponding to a step in the production of the electronic component.
Figure 7:
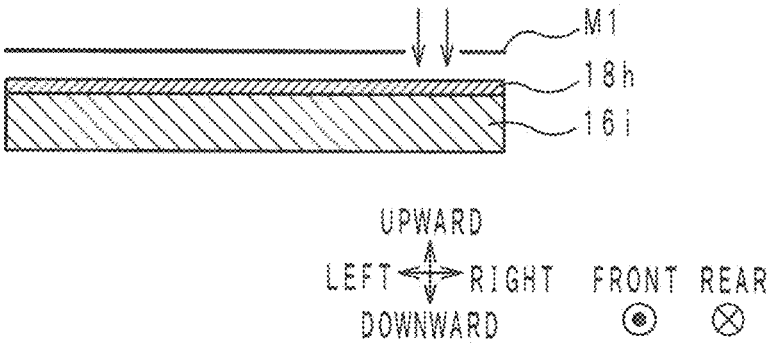
FIG. 7 is a cross-sectional view corresponding to a step in the production of the electronic component.
Figure 8:
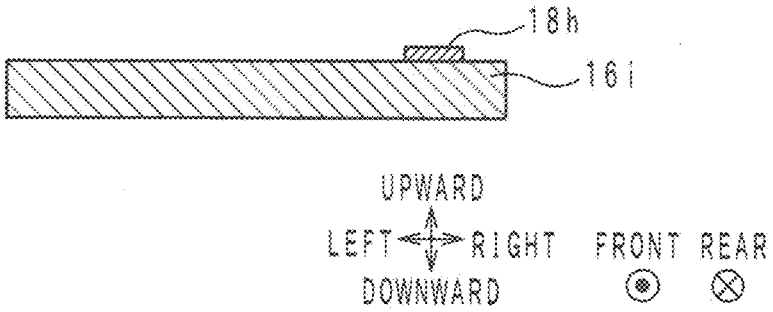
FIG. 8 is a cross-sectional view corresponding to a step in the production of the electronic component.

Next, a photosensitive conductor paste is applied by printing onto the insulator layer 16*i*, as shown in FIG. 6. Thereafter, the photosensitive conductor paste is exposed to light through a mask M1, as shown in FIG. 7. The mask M1 has an opening having the same shape as a coil conductor layer 18*h*. As a result, a portion of the photosensitive conductor paste that is to become a coil conductor layer 18*h* is cured. Moreover, the remaining uncured paste is removed by a developer, as shown in FIG. 8. As a result, a coil conductor layer 18*h* is formed.

Figure 9:
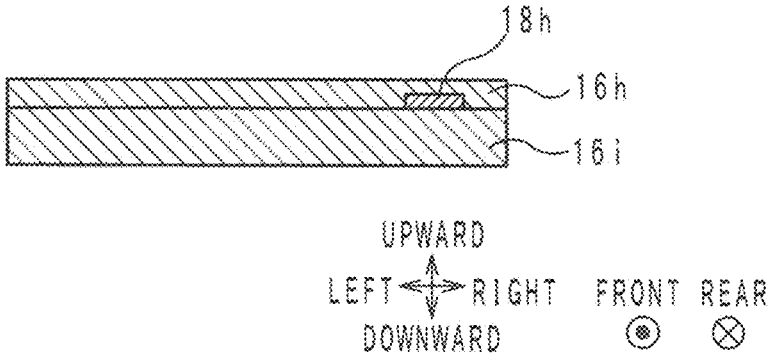
FIG. 9 is a cross-sectional view corresponding to a step in the production of the electronic component.
Figure 10:
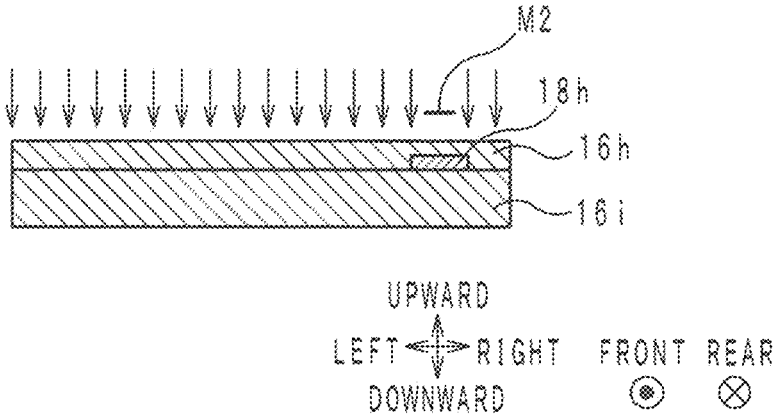
FIG. 10 is a cross-sectional view corresponding to a step in the production of the electronic component.
Figure 11:
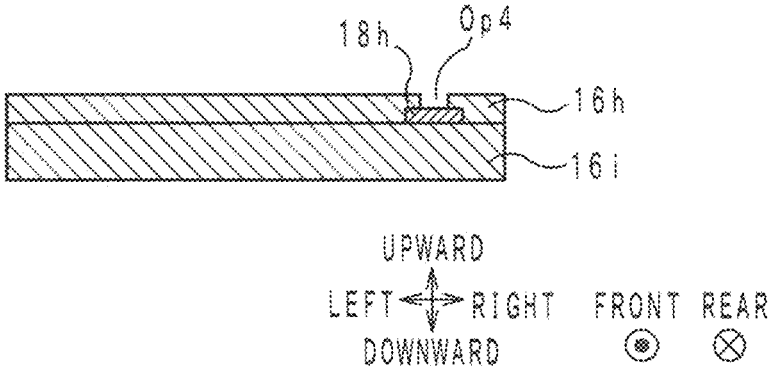
FIG. 11 is a cross-sectional view corresponding to a step in the production of the electronic component.

Next, a photosensitive insulator paste is applied by printing onto the insulator layer 16*i* and the coil conductor layer 18*h*, as shown in FIG. 9. Thereafter, the photosensitive conductor paste is exposed to light through a mask M2, as shown in FIG. 10. The mask M2 covers a portion of the photosensitive insulator paste where an opening Op4 is to be provided. As a result, the photosensitive conductor paste, other than the portion where an opening Op4 is to be provided, is cured. Moreover, the remaining uncured paste is removed by a developer, as shown in FIG. 11. As a result, an insulator layer 16*h* is formed.

Figure 12:
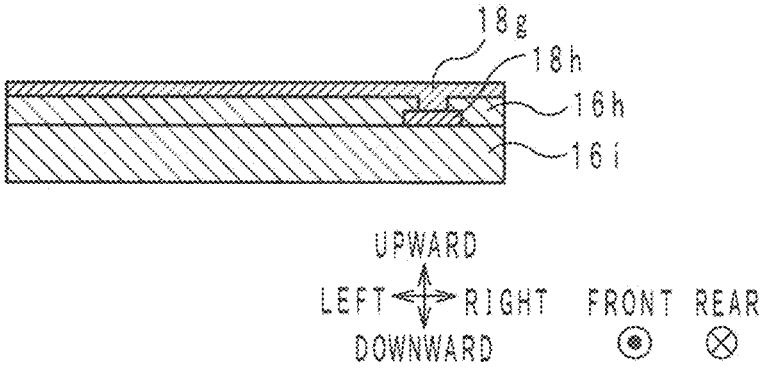
FIG. 12 is a cross-sectional view corresponding to a step in the production of the electronic component.
Figure 13:
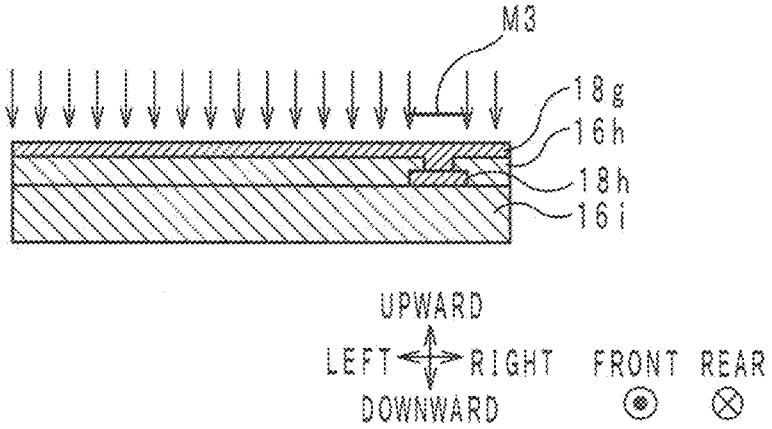
FIG. 13 is a cross-sectional view corresponding to a step in the production of the electronic component.
Figure 14:
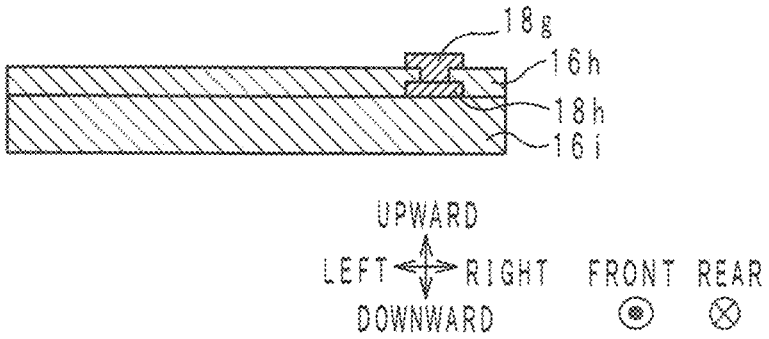
FIG. 14 is a cross-sectional view corresponding to a step in the production of the electronic component.

Next, a photosensitive insulator paste is applied by printing onto the insulator layer 16*h* and also into the opening Op4, as shown in FIG. 12. Thereafter, the photosensitive conductor paste is exposed to light through a mask M3, as shown in FIG. 13. The mask M3 has an opening having the same shape as a coil conductor layer 18*g*. As a result, a portion of the photosensitive conductor paste that is to become a coil conductor layer 18*g* is cured. Moreover, the remaining uncured paste is removed by a developer, as shown in FIG. 14. As a result, a coil conductor layer 18*g* is formed.

Figure 15:
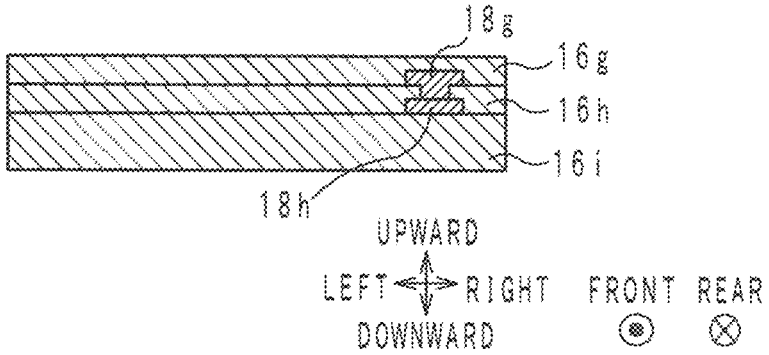
FIG. 15 is a cross-sectional view corresponding to a step in the production of the electronic component.
Figure 16:
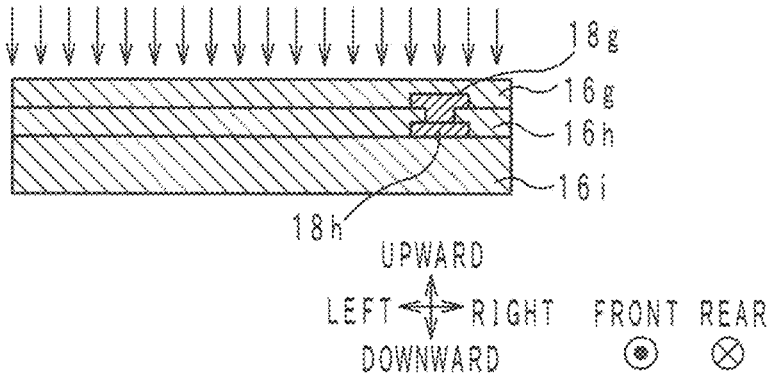
FIG. 16 is a cross-sectional view corresponding to a step in the production of the electronic component.
Figure 17:
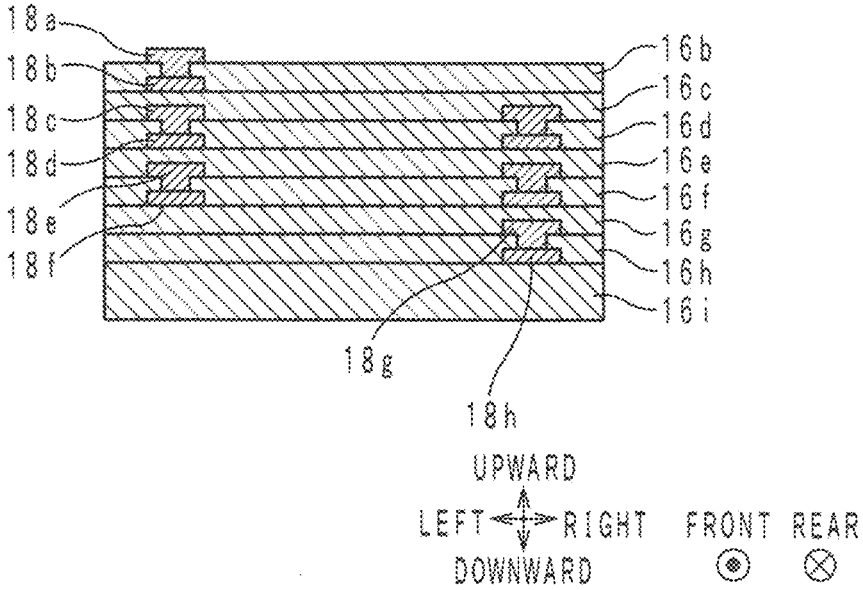
FIG. 17 is a cross-sectional view corresponding to a step in the production of the electronic component.

Next, a photosensitive insulator paste is applied by printing onto the insulator layer 16*h* and the coil conductor layer 18*g*, as shown in FIG. 15. Thereafter, the photosensitive conductor paste is exposed to light through an unillustrated mask, as shown in FIG. 16. The unillustrated mask covers a portion of the photosensitive insulator paste where a through-hole Tc is to be provided. Accordingly, the photosensitive conductor paste, other than the portion where a through-hole Tc is to be provided, is cured. Moreover, the remaining uncured paste is removed by a developer. As a result, an insulator layer 16*g* is formed. Thereafter, the steps of FIGS. 6 through 16 are repeated to form insulator layers 16*b* to 16*f* and coil conductor layers 18*a* to 18*f*, as shown in FIG. 17.

Figure 18:
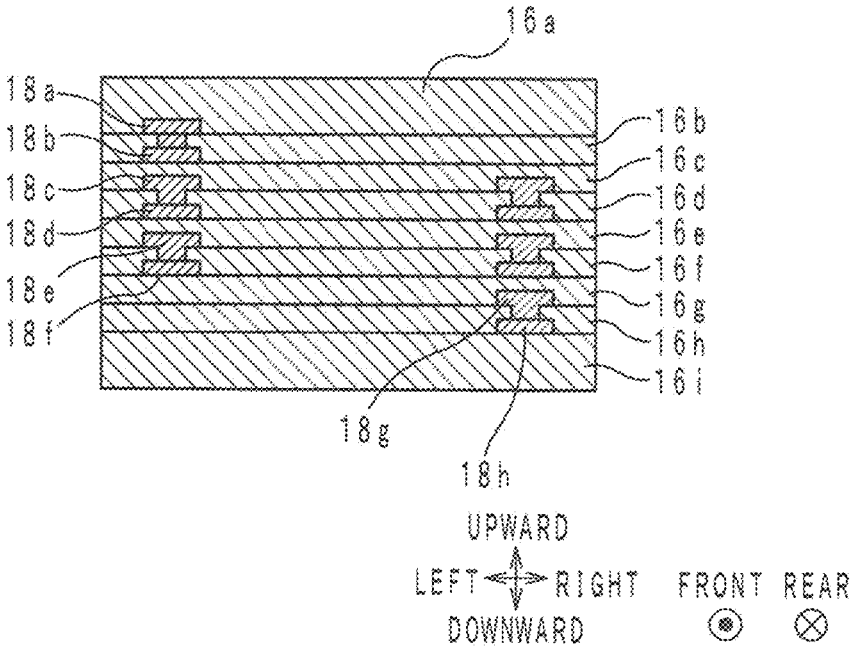
FIG. 18 is a cross-sectional view corresponding to a step in the production of the electronic component.
Figure 19:
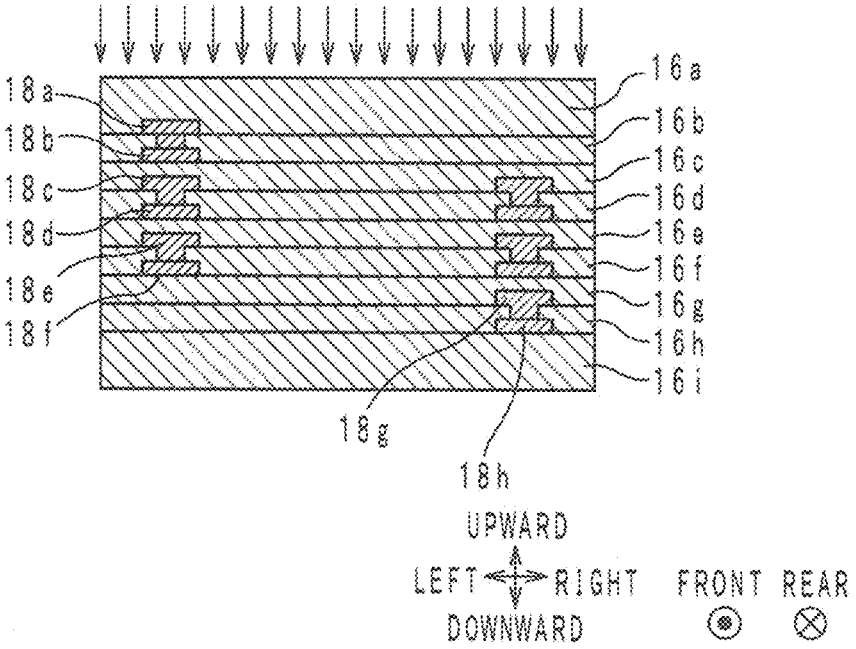
FIG. 19 is a cross-sectional view corresponding to a step in the production of the electronic component.

Next, a photosensitive insulator paste is applied by printing onto the insulator layer 16*b* and the coil conductor layer 18*a*, as shown in FIG. 18. Thereafter, the entire surface of the photosensitive insulator paste is exposed to light, as shown in FIG. 19. As a result, the photosensitive insulator paste is cured, so that an insulator layer 16*a* is formed. Further, an insulator paste is applied by printing onto the insulator layer 16*a*, thereby forming an insulator layer 25. Thus, a mother laminate made up of a plurality of laminates 12 is obtained.

Next, the mother laminate is cut into a plurality of unsintered laminates 12 by a dicing saw or suchlike. In addition, the laminates 12 are sintered under predetermined conditions.

Next, a conductive paste made of Ag is applied to opposite end surfaces of the laminate 12 by dipping, and the end surfaces are baked to form electrode bases. Lastly, the electrode bases are plated with Ni, Cu, Sn, or the like, thereby forming external electrodes 14*a* and 14*b*. By the foregoing process, the electronic component 10 is completed.

Effects

The electronic component 10 according to the present embodiment renders it possible to achieve a large inductance value. More specifically, the helical coil L has a high density of magnetic flux therein. Magnetic flux that does not flow through the coil L passes through the surfaces of the coil conductor layers 18*a* to 18*h*. In this manner, when magnetic flux passes through the coil conductor layers 18*a* to 18*h*, eddy currents are set up, resulting in a reduced inductance value of the coil L.

Here, magnetic flux that does not flow through the coil L passes near the surfaces of the coil conductor layers 19*a* to 19*d* that are directed toward the inner circumference side of the coil L. Accordingly, eddy currents tend to be set up also near the surfaces of the coil conductor layers 19*a* to 19*d* that are directed toward the inner circumference side of the coil L. Therefore, in the electronic component 10, the surfaces of the coil conductor layers 19*a* to 19*d* that are directed toward the inner circumference side of the coil L have recesses Ga to Gd provided so as to be set back toward the outer circumference side of the coil L. As a result, the coil conductor layers 19*a* to 19*d* are thinner in the top-bottom direction near the surfaces directed toward the inner circumference side of the coil L. Accordingly, the distance that the magnetic flux passes through the coil conductor layers 19*a* to 19*d* becomes shorter. Thus, eddy currents which are set up in the coil conductor layers 19*a* to 19*d* are reduced, so that the inductance value of the coil L can be inhibited from being reduced. Note that the computer simulations to be described below demonstrate that the depth D1 of the recesses Ga to Gd is preferably 6 μm or more, which is 40% or less of the width W1 or W2 of the coil conductor layers 18*a* to 18*h*.

Computer Simulations

To confirm that the foregoing correctly describes the principle of increasing the inductance value of the coil L, the present inventors carried out computer simulations to be described below. The coil conductor layers 19*a* to 19*d* had respective recesses Ge to Gh provided in the surfaces directed toward the outer circumference side of the coil L, as shown in the enlarged view in FIG. 3. The depth of the recesses Ge to Gh is denoted by D2. The inventors calculated inductance values of the coil L with different values of the depths D1 and D2. The details of first through third models used in the computer simulations will be described below.

First Model:
Depth D1: 0 μm
Depth D2: 0 μm
Second Model:
Depth D1: 10 μm
Depth D2: 0 μm
Third Model:
Depth D1: 0 ∞m
Depth D2: 10 μm For the first model, the inductance value was 2.276 nH. For the second model, the inductance value was 2.321 nH. That is, the inductance value for the second model was higher by 0.045 nH than that for the first model. On the other hand, for the third model, the inductance value was 2.282 nH. That is, the inductance value for the third model is higher only by 0.006 nH than that for the first model. In this manner, it can be appreciated that, in the case where the coil conductor layers 19*a* to 19*d* have the recesses Ga to Gd provided in the surfaces directed toward the inner circumference side of the coil L, the inductance value of the coil L is higher than in the case where the coil conductor layers 19*a* to 19*d* have the recesses Ga to Gd in the surfaces directed toward the outer circumference side of the coil L. Therefore, on the basis of the computer simulations, it is thought that by providing the recesses Ga to Gd, it is rendered possible to reduce eddy currents set up in the coil conductor layers 19*a* to 19*d*, so that the inductance value of the coil L can be inhibited from being reduced.

Next, to find an optimal depth D1 for the recesses Ga to Gd, fourth through seventh models as detailed below were created, and inductance values for the models were calculated.

Fourth Model:

Width (W1 or W2) of the coil conductor layers 19*a* to 19*d*: 70 μm Thickness of the coil conductor layers 19*a* to 19*d*: 12 μm Fifth Model:

Width (W1 or W2) of the coil conductor layers 19*a* to 19*d*: 60 μm Thickness of the coil conductor layers 19*a* to 19*d*: 12 μm Sixth Model:

Width (W1 or W2) of the coil conductor layers 19*a* to 19*d*: 40 μm Thickness of the coil conductor layers 19*a* to 19*d*: 12

Figure 20:
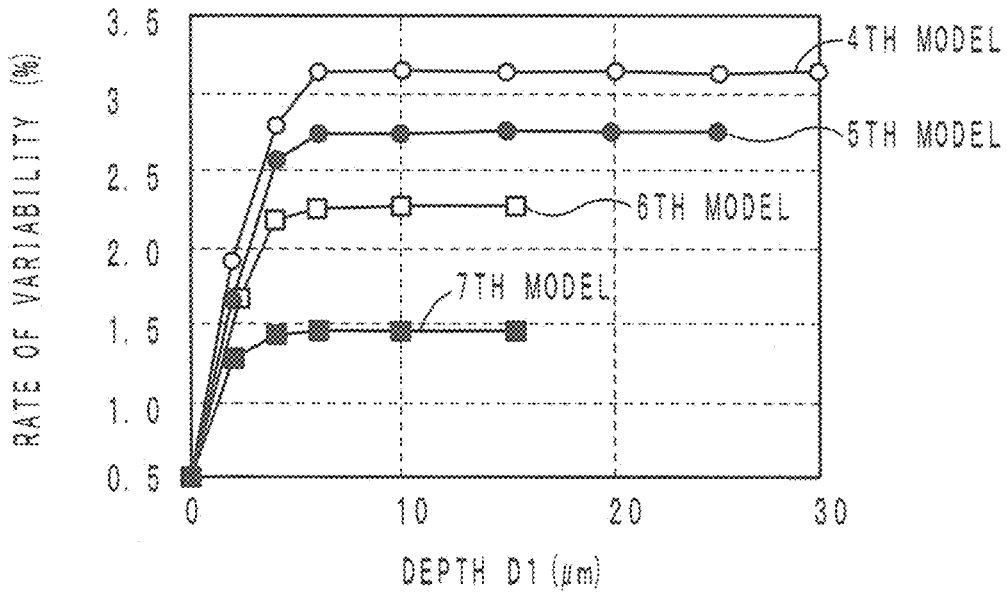
FIG. 20 is a graph showing simulation results.

Seventh Model:

Width (W1 or W2) of the coil conductor layers 19*a* to 19*d*: 40 μm Thickness of the coil conductor layers 19*a* to 19*d*: 8 μm For the fourth through seventh models, inductance values of the coil L were calculated with different values of the depth D1 of the recesses Ga to Gd. FIG. 20 is a graph showing simulation results. The vertical axis represents the percentage change of the inductance value, and the horizontal axis represents the depth D1 of the recesses Ga to Gd. The percentage change of the inductance value refers to a percentage change relative to the inductance value where the depth D1 is 0 μm.

It can be appreciated from FIG. 20 that for all of the fourth through seventh models, the inductance value increased with the depth D1. In addition, for all of the fourth through seventh models, the inductance value barely increased where the depth D1 was 6 μm or more. Therefore, it can be appreciated that the depth D1 is preferably 6 μm or more. Note that the inventors calculated inductance values with the depth D1 at 10 μm. Thus, the depth D1 is preferably 10 μm or less.

Furthermore, for the fourth model, it was found that the inductance value barely changed where the depth D1 was up to 30 μm. For the fourth model, the width W1 was 70 μm. Accordingly, for the fourth model, the inductance value barely changed where the depth D1 was 42.8% or less of the width W1. Similarly, for the fifth model, it was found that the inductance value barely changed where the depth D1 was up to 25 μm. For the fifth model, the width W1 was 60 μm. Accordingly, for the fifth model, the inductance value barely changed where the depth D1 was 42.5% or less of the width W1. For the sixth model, it was found that the inductance value barely changed where the depth D1 was up to 16 μm. For the sixth model, the width W1 was 40 μm. Accordingly, for the sixth model, the inductance value barely changed where the depth D1 was 40.0% or less of the width W1. For the seventh model, it was known that the inductance value barely changed where the depth D1 was up to 16 μm. For the seventh model, the width W1 was 40 μm. Accordingly, for the seventh model, the inductance value barely changed where the depth D1 was 40.0% or less of the width W1. Thus, the depth D1 of the recesses Ga to Gd is preferably 40% or less of the width W1 or W2 of the coil conductor layers 18*a* to 18*h*.

Other dimensions of the coil conductor layers 19*a* to 19*d* will also be described. It is preferable that the portions of the coil conductor layers 18*a*, 18*c*, 18*e*, and 18*g* that are positioned on the insulator layers 16*b*, 16*d*, 16*f*, and 16*h*, respectively, as shown in FIG. 3, have a thickness H1 of from 8 μm to 12 μm. Moreover, it is preferable that the portions of the coil conductor layers 18*a*, 18*c*, 18*e*, and 18*g* that are positioned in the openings Op1 to Op4, respectively, have a thickness H3 of 7 μm. In addition, the coil conductor layers 18*b*, 18*d*, 18*f*, and 18*h* preferably have a thickness H2 of from 8 μm to 12 μm.

Method for Measuring Recess Depth

The method for measuring the depth D1 of the recesses Ga to Gd will be described below with reference to the drawings.

Figure 21:
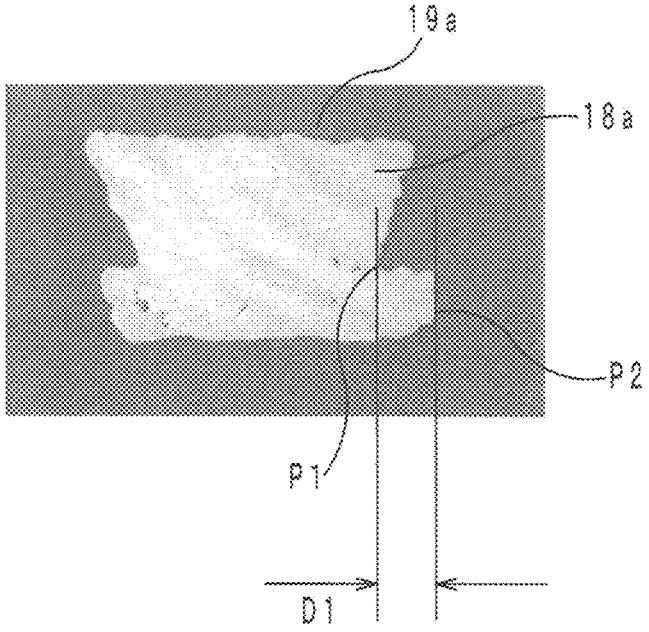
FIG. 21 is a photograph showing a cross-sectional structure of a coil conductor layer.

Initially, curable resin is applied to the electronic component 10 and hardened. The electronic component 10 with the hardened resin is ground to expose a cross section of the coil conductor layer 19*a*. Further, the exposed cross section of the coil conductor layer 19*a* is buffed to eliminate grounding flaws therefrom. Thereafter, an image of the cross section of the coil conductor layer 19*a* is taken by a laser microscope (VK-8700 from Keyence Corp.). FIG. 21 is a photograph showing the cross-sectional structure of the coil conductor layer 19*a*.

In actuality, the cross-sectional shape of the coil conductor layer 19*a* is significantly different from the shape of an H, as shown in FIG. 21. Therefore, in the case where the depth D1 of any of the recesses Ga to Gd is measured, the bottom of that recess is determined first. For example, in the case of the recess Ga, its bottom, which is denoted by P1 in FIG. 21, is the closest portion to the outer circumference side of the coil L. Next, the entrance of the recesses Ga to Gd is determined. For example, in the case of the recess Ga, its entrance, which is denoted by P2, corresponds to the closest portion of the coil conductor layer 19*a* to the inner circumference side of the coil L, as shown in FIG. 21. Thereafter, the distance between the portions P1 and P2 in the right-left direction is measured and set as a depth D1. By the above process, the depth D1 can be measured.

Modification

Figure 22:
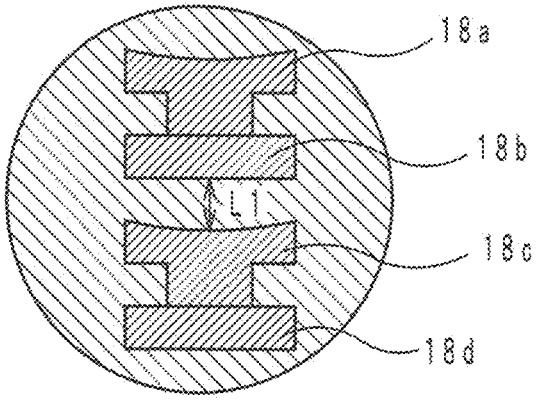
FIG. 22 is a cross-sectional structure view of a coil conductor layer.

Hereinafter, an electronic component 10*a* according to a modification will be described with reference to the drawings. FIG. 22 is a cross-sectional structure view of the coil conductor layer 19*a*. For the external oblique view and the exploded oblique view of the electronic component 10*a*, FIGS. 1 and 2 will be referenced.

The electronic component 10*a* differs from the electronic component 10 in terms of the cross-sectional shape of the coil conductor layers 19*a* to 19*d*. In the following, the cross-sectional shape of the coil conductor layers 19*a* to 19*d* will be described, but any descriptions of other features will be omitted.

The surface of the coil conductor layer 18*c* that is opposite to the coil conductor layer 18*b* with the insulator layer 16c positioned therebetween, i.e., the upper surface of the coil conductor layer 18*c*, is concave. Accordingly, the distance between the coil conductor layers 18*b* and 18*c* is increased. As a result, an increase in insertion loss in the electronic component 10*a* due to proximity effect is inhibited. While the foregoing has been given by taking as an example the relationship between the coil conductor layers 18*b* and 18*c*, the same can be said of the relationship between the coil conductor layers 18*d* and 18*e* and also of the relationship between the coil conductor layers 18*f* and 18*g*.

To clearly demonstrate that the insertion loss in the electronic component 10*a* is suppressed, the inventors carried out computer simulations to be described below. Specifically, the inventors created eighth through tenth models as will be detailed below, and studied the relationship of the frequency of a high-frequency signal with a quality factor.

The specifications common among the eighth through tenth models are as follows:

Width (W1 or W2) of each coil conductor layer: 65 μm

Number of coil conductor layers: 5

Number of winds of the coil L: 4.5

Distance from the coil L to the end surface of the laminate: 23 μm

The distance L1 between the coil conductor layers 18*b* and 18*c* is shown below for each model:

Eighth model: 5 μm

Ninth model: 10 μm

Tenth model: 15 μm

Figure 23:
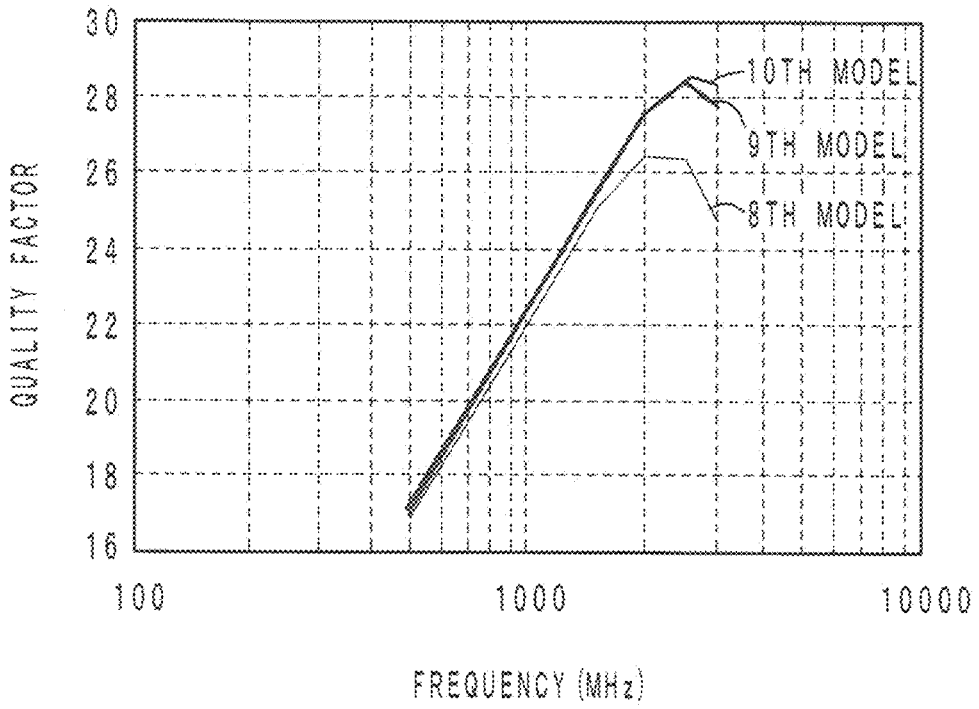
FIG. 23 is a graph showing simulation results.

FIG. 23 is a graph showing simulation results. The vertical axis represents the quality factor, and the horizontal axis represents the frequency. It can be appreciated from FIG. 23 that the quality factor peaks at a higher level as the distance L1 increases. Specifically, it can be appreciated that an increase in the distance L1 between the coil conductor layers 18*b* and 18*c* due to the upper surface of the coil conductor layer 18*c* being concave results in an increase in the quality factor in the electronic component 10*a*. Thus, it can be appreciated that the insertion loss in the electronic component 10*a* can be suppressed by increasing the distance L1.

Furthermore, it can be appreciated from FIG. 23 that the peak quality factor was significantly improved when the distance L1 was 10 μm or more. Thus, the distance L1 is preferably 10 μm or more.

Other Embodiments

The present disclosure is not limited to the electronic components 10 and 10*a*, and variations can be made within the spirit and scope of the disclosure.

Note that the electronic components 10 and 10*a* are provided with the recesses Ge to Gh, but the recesses Ge to Gh are not indispensable.

Furthermore, in the case of the electronic components 10 and 10*a*, the coils L are helical coils, but they may be any coils that are in the form of, for example, spirals when viewed in a top view. Moreover, the coils L may be helical coils formed by connecting a plurality of spiral coil conductor layers.

Although the present disclosure has been described in connection with the preferred embodiment above, it is to be noted that various changes and modifications are possible to those who are skilled in the art. Such changes and modifications are to be understood as being within the scope of the disclosure.

What is claimed is:

1. An electronic component comprising:

a laminate formed by laminating a plurality of insulator layers;

a coil including linear coil conductor layers laminated along with the insulator layers, the coil having a spiral form; and via-hole conductors extending through the insulator layers and connecting the coil conductor layers, wherein, in a cross section perpendicular to a direction in which the coil conductor layers extend, the coil conductor layers have recesses provided in surfaces directed toward an inner circumference side of the coil, the recesses being set back toward an outer circumference side of the coil, the recesses are positioned in portions of the coil conductor layers a spaced distance from the via-hole conductors along the direction in which the coil conductor layers extend, and the recesses have a depth of greater than or equal to 6 μm and less than 20 μm.

2. The electronic component according to claim 1, wherein a depth of the recesses is 40% or less of the width of a coil conductor layers.

3. The electronic component according to claim 1, wherein, the insulator layers include first insulator layers and second insulator layers laminated thereon, the coil conductor layers include first and second coil conductor layers, the first coil conductor layers are provided on the first insulator layers, the second insulator layers have linear openings narrower than the first and second coil conductor layers, the openings overlapping with the first coil conductor layers when viewed in a plan view in a direction of lamination, and the second coil conductor layers are provided on the second insulator layers so as to be partially positioned in the openings.

4. The electronic component according to claim 1, wherein the recesses have a depth of greater than or equal to 6 μm and less than or equal to 16 μm.

5. An electronic component comprising:

a laminate formed by laminating a plurality of insulator layers;

a coil including linear coil conductor layers laminated along with the insulator layers, the coil having a helical form which windingly extends in a direction of lamination; and via-hole conductors extending through the insulator layers and connecting the coil conductor layers, wherein, in a cross section perpendicular to a direction in which the coil conductor layers extend, the coil conductor layers have recesses provided in surfaces directed toward an inner circumference side of the coil, the recesses being set back toward an outer circumference side of the coil, the recesses are positioned in portions of the coil conductor layers a spaced distance from the via-hole conductors along the direction in which the coil conductor layers extend, and the recesses have a depth of greater than or equal to 6 μm and less than 20 μm.

6. The electronic component according to claim 5, wherein a depth of the recesses is 40% or less of the width of the coil conductor layers.

7. The electronic component according to claim 5, wherein, the insulator layers include first insulator layers and second insulator layers laminated thereon, the coil conductor layers include first and second coil conductor layers, the first coil conductor layers are provided on the first insulator layers, the second insulator layers have linear openings narrower than the first and second coil conductor layers, the openings overlapping with the first coil conductor layers when viewed in a plan view in a direction of lamination, and the second coil conductor layers are provided on the second insulator layers so as to be partially positioned in the openings.

8. The electronic component according to claim 7, wherein, the first insulator layers and the second insulator layers are laminated so as to alternate with each other, the coil is a helical coil formed by connecting the coil conductor layers each including the first and second coil conductor layers, and the second coil conductor layers have concave surfaces each being opposite to the first coil conductor layer with the first insulator layer positioned therebetween.

9. The electronic component according to claim 5, wherein the recesses have a depth of greater than or equal to 6 μm and less than or equal to 16 μm.

* * * * *